US008096851B2

(12) United States Patent
Fine

(10) Patent No.: US 8,096,851 B2
(45) Date of Patent: Jan. 17, 2012

(54) DETACHABLE AND REMOVABLE CAMISOLE PANEL

(75) Inventor: Linda Fine, New York, NY (US)

(73) Assignee: Fine and Associates Inc., New York, NY (US)

( * ) Notice: Subject to any disclaimer, the term of this patent is extended or adjusted under 35 U.S.C. 154(b) by 31 days.

(21) Appl. No.: 12/383,630

(22) Filed: Mar. 26, 2009

(65) Prior Publication Data

US 2009/0247046 A1 Oct. 1, 2009

Related U.S. Application Data

(60) Provisional application No. 61/070,936, filed on Mar. 26, 2008.

(51) Int. Cl.
*A41C 3/00* (2006.01)

(52) U.S. Cl. ..... 450/1; 450/86; 2/104; 2/49.1

(58) Field of Classification Search ..... 2/105, 104, 2/106, 73, 78.1–78.4, 46, 51, 49.1–49.4, 2/69, 67, 109, 144, 145; 450/86, 88, 1
See application file for complete search history.

(56) References Cited

U.S. PATENT DOCUMENTS

| | | | | | |
|---|---|---|---|---|---|
| 731,759 | A | * | 6/1903 | Dieter | 2/48 |
| 2,009,620 | A | | 7/1935 | Jackson | |
| 2,567,524 | A | * | 9/1951 | Morganti | 2/48 |
| 2,707,786 | A | * | 5/1955 | Stoner | 2/119 |
| 3,064,265 | A | * | 11/1962 | Bridgewaters | 2/74 |
| 3,297,035 | A | | 1/1967 | Wright | |
| 3,623,487 | A | | 11/1971 | Chiu | |
| 4,372,320 | A | | 2/1983 | Silber | |
| 4,564,015 | A | | 1/1986 | Friedman | |
| 5,045,018 | A | | 9/1991 | Costanzo | |
| 5,097,537 | A | | 3/1992 | Ewing | |
| 5,729,836 | A | | 3/1998 | Ewing | |
| 5,807,160 | A | * | 9/1998 | Wehmeyer | 450/57 |
| 6,155,906 | A | | 12/2000 | May | |
| 6,183,340 | B1 | | 2/2001 | Wen | |
| 6,206,752 | B1 | | 3/2001 | Fagin et al. | |
| 6,811,462 | B1 | | 11/2004 | Kenneally | |
| 6,935,921 | B1 | * | 8/2005 | Eudenbach et al. | 450/54 |
| 7,083,494 | B2 | | 8/2006 | Sandroussi et al. | |
| 7,188,372 | B2 | * | 3/2007 | Stockard | 2/104 |
| 7,409,728 | B2 | * | 8/2008 | Harry | 2/106 |
| 7,520,794 | B1 | * | 4/2009 | Johnson | 450/1 |
| 7,780,502 | B2 | * | 8/2010 | Calamari et al. | 450/86 |
| 2004/0137821 | A1 | | 7/2004 | Sandroussi et al. | |
| 2006/0166600 | A1 | | 7/2006 | Ravoiu et al. | |
| 2007/0281585 | A1 | * | 12/2007 | Calamari et al. | 450/1 |
| 2009/0093189 | A1 | * | 4/2009 | Frey | 450/1 |

OTHER PUBLICATIONS

The Vermont Country Store, "Lace Cami Inserts", found Oct. 12, 2009, 2 pages, http://www.vermontcountrystore.com/browse/Home/Apparel/Women...

(Continued)

*Primary Examiner* — Gloria Hale
(74) *Attorney, Agent, or Firm* — Saile Ackerman LLC; Stephen B. Ackerman

(57) ABSTRACT

A camisole panel is described comprised of a triangular shaped fabric material having a top portion with two top sides and a bottom portion with one bottom side centered underneath the top portion. The top sides of the panel each have a means to attach to the user's undergarment. The bottom side of the panel is tucked into the user's waistband.

23 Claims, 6 Drawing Sheets

OTHER PUBLICATIONS

The Winkee/ The Ultimate Solution for Plunging Necklines!, found Oct. 13, 2009, 2 pages, http:www.thewinkee.com/index.html.

Talk of the Town Fashions, LLC, "Boob Blocker", found Oct. 13, 2009, 2 pages, http://www.talkofthetownfashions.com/main.html.

* cited by examiner

DETACHABLE AND REMOVABLE CAMISOLE PANEL

This patent application claims the benefit of U.S. Provisional Application Ser. No. 61/070,936 filed on Mar. 26, 2008, and herein incorporated by reference in its entirety.

FIELD OF THE INVENTION

The present invention relates to a triangular shaped camisole panel which attaches to a user's undergarment using snaps, pins, or elastic straps.

BACKGROUND OF THE INVENTION

In today's workplace the corporate dress code calls for women to wear suits that in many ways simulate a very masculine look, very similar to a man's suit. This look is rather unflattering and women desire to add a feminine touch to their look without breaking their wardrobe budget. By adding a layer of fabric that is visible under the suit jacket, blouse, sweater or dress, the invention achieves a feminine flair while still dressing appropriately for the workplace.

Numerous prior art patents and publications are currently known directed to bras, body support garments, slips and hosiery. Representative publications and patents include U.S. Patent Publication No. 2006/0166600 A1 to Ravoiu et al.; U.S. Patent Publication No. 2004/0137821 A1 to Sandroussi et al.; U.S. Pat. No. 7,083,494 B2 Sandroussi et al.; U.S. Pat. No. 6,811,462 B1 to Kenneally; U.S. Pat. No. 6,206,752 B1 to Fagin et al.; U.S. Pat. No. 6,183,340 B1 to Wen; U.S. Pat. No. 6,155,906 to May; U.S. Pat. Nos. 5,729,836 and 5,097,537 to Ewing; U.S. Pat. No. 4,564,015 to Friedman; U.S. Pat. No. 4,372,320 to Silber; U.S. Pat. No. 3,623,487 to Chiu; U.S. Pat. No. 3,297,035 to Wright; and U.S. Pat. No. 2,009,620 to Jackson.

U.S. Pat. No. 5,045,018 to Costanzo discloses a camisole combined with a bra. This garment however includes shoulder straps as well as a back support. U.S. Patent Application No. 2007/0281585 to Calamari et al discloses a partial undergarment attached to a bra.

In addition to the patents and publications products are available for sale which are "backless camisoles." These products however all include shoulder straps.

Unlike the present invention, it does not appear that any of these patent references or products discloses a strapless, backless camisole with means for easy attachment to the user's undergarments.

The invention provides an alternative to the expensive camisoles that are currently available. A camisole panel comprised of a triangular shaped fabric material having a top portion with two top sides and a bottom portion with one bottom side centered underneath the top portion, wherein the top sides each have a means to attach to the user's undergarment is provided. The camisole panel of the invention is a wonderful and cost effective solution to the problem.

The fabric panel is attached directly to a user's undergarment, preferably a bra, at key points. The invention can be worn under jackets, blouses, dresses or sweaters; adding a feminine touch at a fraction of the cost.

An advantage of wearing the invention fabric panel rather than a full camisole also provides a seamless look underneath form-fitted jackets, blouses, dresses or sweaters.

Another benefit of the invention is that it provides extra coverage when worn under a shirt, jacket, sweater or dress that may reveal a little too much cleavage for a conservative workplace or event. It seems to move wardrobe pieces that were unfit for the office to garments that, with the addition of this stretch fabric panel, become appropriate for the workplace.

SUMMARY OF THE INVENTION

In the present invention, these purposes, as well as others which will be apparent, are achieved generally by providing a camisole panel comprised of a triangular shaped fabric material having a top portion with two top sides and a bottom portion with one bottom side centered underneath the top portion. The top sides of the panel each have a means to attach to the user's undergarment.

The undergarment the panel is preferably attached to is a bra, although other undergarments are included within the invention.

The means to attach the invention to the undergarment is preferably by either snaps, pins or elastic straps.

The invention also includes a method for applying a camisole panel by providing a camisole panel comprised of a triangular shaped fabric material having a top portion with two top sides and a bottom portion with one bottom side centered underneath the top portion. The top sides of the panel each have a means to attach to the user's undergarment. As described above, the panel is attached either using snaps, pins or elastic straps. The bottom side of the panel is then tucked under the bottom of the user's undergarment to secure the camisole panel on the user.

Other objects, features and advantages of the present invention will be apparent when the detailed description of the preferred embodiments of the invention are considered with reference to the drawings, which should be construed in an illustrative and not limiting sense.

DETAILED DESCRIPTION OF THE INVENTION

In accordance with the present invention a camisole panel comprised of a triangular shaped fabric material having a top portion with two top sides and a bottom portion with one bottom side centered underneath the top portion, wherein the top sides each have a means to attach to the user's undergarment is provided.

Figure 1A:
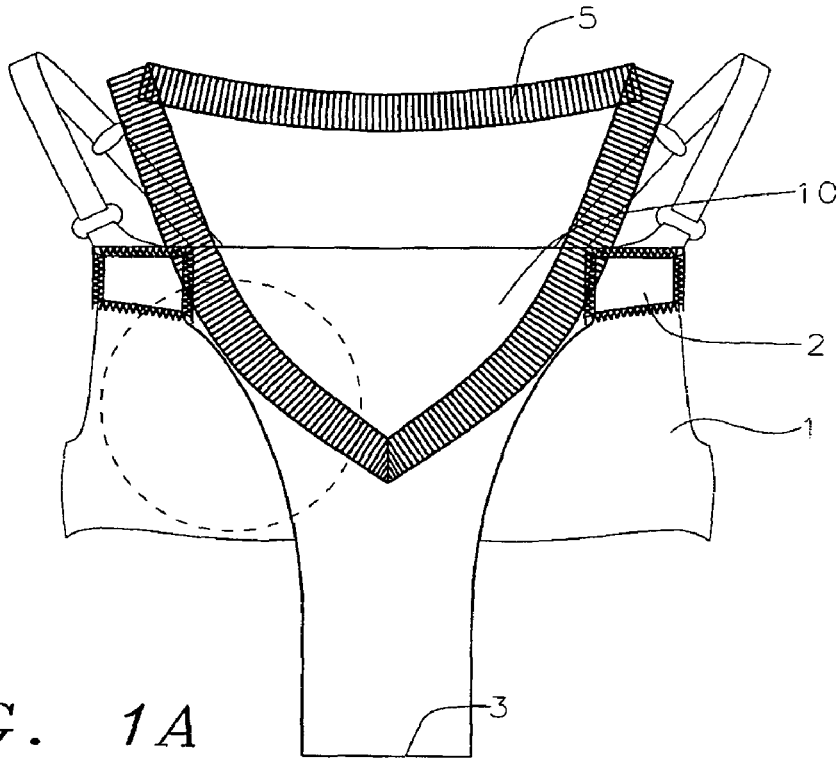
FIGS. 1A and 1B are illustrations of the general features of the invention.
Figure 1B:
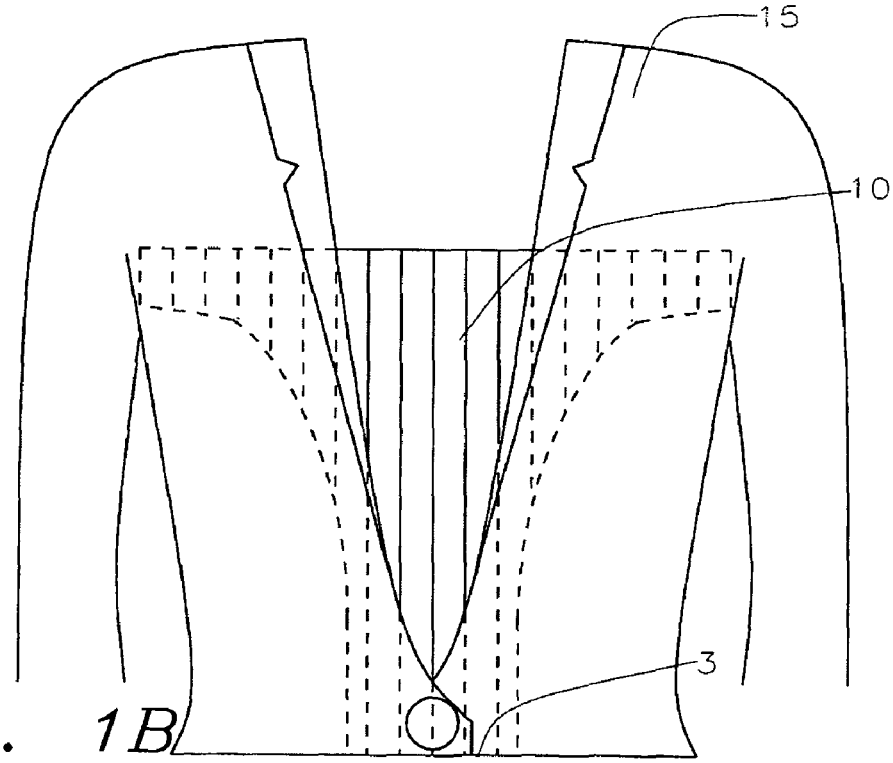

In general, FIGS. 1A and 1B illustrate the components of the invention which is an approximately triangular shaped fabric panel 10, the two top side straps 2, a bottom side 3, and the undergarment 1. The collar 5 of an outer garment is also shown.

The purpose of the invention is to provide coverage underneath an article of outer clothing, such as a blouse or a suit jacket, dress or sweater. By attaching the invention to her bra at key points, the user will be able to wear the panel underneath a layer of clothing. By doing so, the user may benefit in two ways:

1—She has added a decorative and unique touch to her outfit, and

2—She has also added a layer of fabric that serves as extra coverage under a blouse, jacket, dress or sweater that exposes too much cleavage.

For example, FIG. 1A shows the camisole panel 10 under the collar 5 of a sweater or dress. A popular fashion is a jacket that is fastened only at or near the waist, as shown, for example, in FIG. 1B. Since the camisole panel 10 extends to the waistband, full coverage is provided underneath such a jacket 15. Additionally, coverage is provided under any outergarment having a deep v-neck.

The invention is an accessory that provides a decorative touch and also provides additional coverage. The panel accomplishes these benefits without adding a full layer of clothes, which could result in a bulky look. Additionally, it eliminates the issue of straps that would fall out of place or show, or having the camisole slipping from under a shirt or pants. It also is a product that "One size fits most".

The invention is a piece of fine fabric with finished, reinforced edges that can be stretched to fit as "One size fits most". The panel will be available in a variety of fabrics, styles and colors. The FIGS. 1 to 10 illustrate the shapes and dimensions of the invention itself. The camisole panel of the invention is a two-way stretch fabric. Most fabrics stretch only one way, but the two-way stretch fabric of the invention will pull and snap so that it is taut in all directions.

The edges of the fabric panel will also have a reinforcing fabric or slip-resistant silicone feature along the edges on both sides, so that the product does not ride up when placed against the bra itself.

Figure 2:
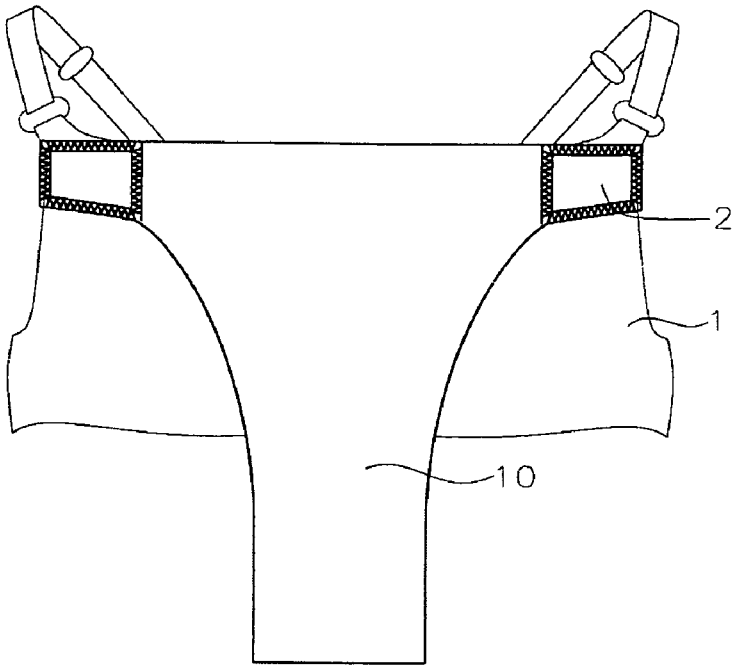
FIG. 2 illustrates a front view of a first preferred embodiment of the invention.

The panel of stretch fabric is attached at key points preferably by the use of snaps. FIG. 2 illustrates a front view of the fabric panel 10 to be attached to an undergarment 1. The snaps 6 are attached to reinforcing fabric 4, shown in the back view of the fabric panel in FIG. 3.

The reinforcing fabric 4 on the backside of the fabric panel is in the area where the fabric will be attached to the bra straps. By attaching the snaps to the reinforcing fabric, tears to the fragile fabric of the panel are avoided. The edges of the fabric panel will also have reinforcing fabric or slip-resistant silicone feature 9 along the edges on both sides and bottom, so that the product does not ride up when placed against the bra itself.

Figure 3:
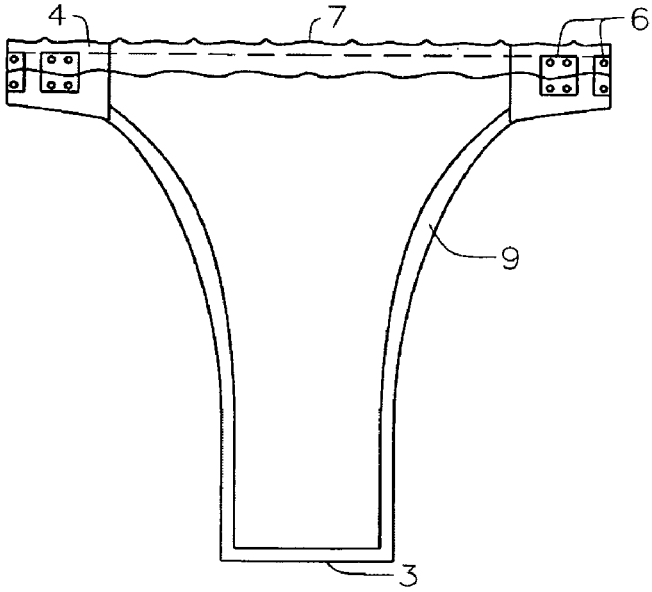
FIG. 3 illustrates a back view of a first preferred embodiment of the invention.

FIG. 3 shows four snaps on the inner snap section and two snaps on the outer snap section, for example. The two snaps of the outer snap section attach to one of the two rows of inner snaps. The extra row of snaps allows for better fitting, depending on the width of the bra strap, for example. The snaps are mounted on a fabric strip backing. The fabric strip backing is then single-needle stitched to the reinforcing fabric 4 of the panel at all four corners of the snaps.

Figure 4:
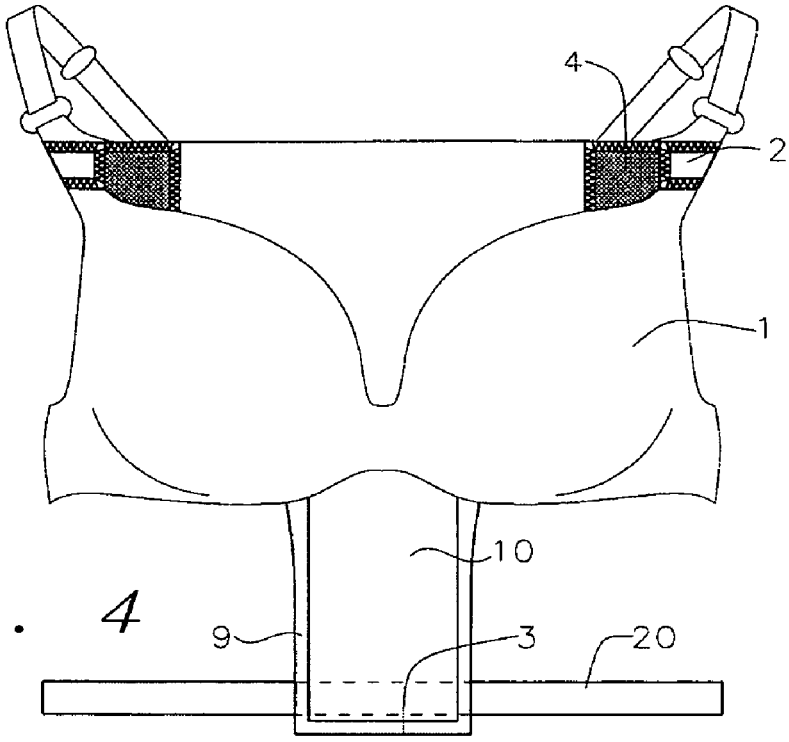
FIG. 4 illustrates a back view of a first preferred embodiment of the invention as applied to a user's undergarment.

FIG. 4 shows the attachment of the fabric panel 10 to the undergarment 1 from the back view. Tabs 2 are folded around the straps of the undergarment 1 and attached by snaps on the reinforcing fabric 4.

FIG. 3 shows a silicone elastic zigzag 7 attached to the top edge of the panel. This is one example of the many ways in which the fabric panel can be made to be decorative.

Figure 5:
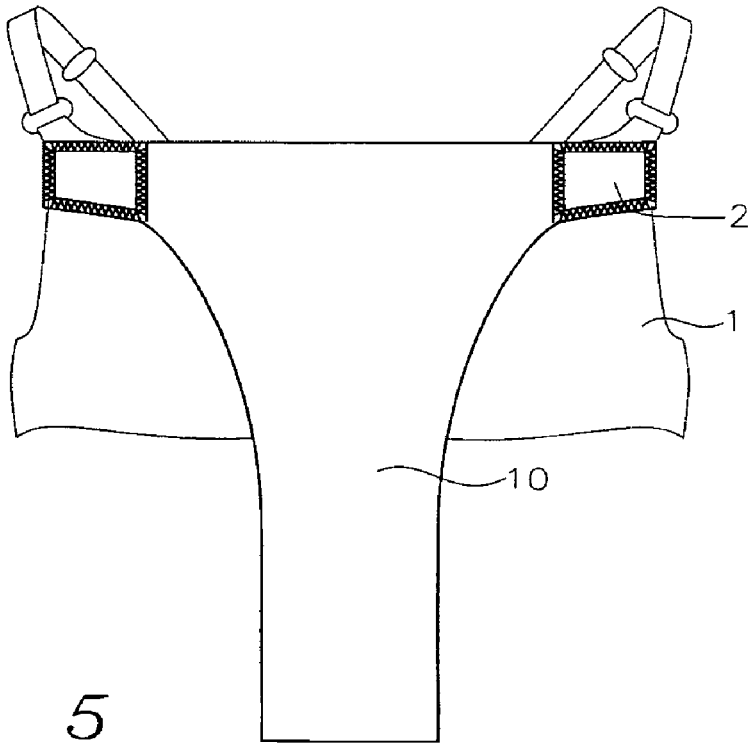
FIG. 5 illustrates a front view of a second preferred embodiment alternate embodiment of the invention.
Figure 6:
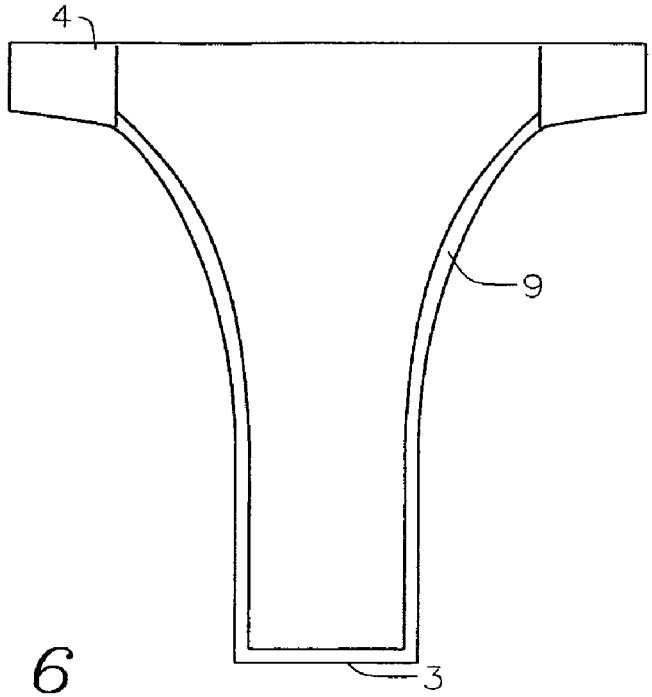
FIG. 6 illustrates a back view of a second preferred embodiment of the invention with two elastic straps.
Figure 7:
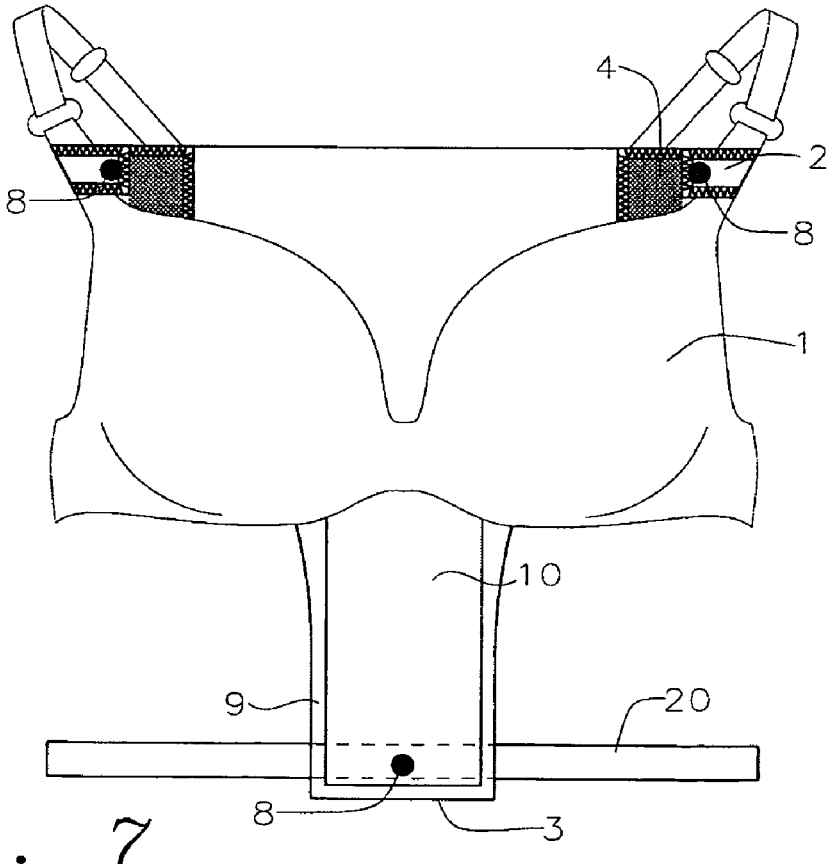
FIG. 7 illustrates a back view of a second preferred embodiment of the invention as applied to a user's undergarment.

As an alternative, in the second preferred embodiment of the invention, as shown in FIGS. 5-7, pins can be used to attach the fabric panel to the bra. For example, the pins can have a flat, round face and a post with a safety back. These pins 8 will be used to attach the invention to each bra strap by pulling the stretch panel taut and wrapping around the first bra strap, then pushing the pin post through the fabric panel and bra strap, and securing with the safety back. Once the one side of the stretch panel is secured, the user will position the panel by stretching it to wrap around the other bra strap, making sure that it is level across the chest and at the desired height, giving the user a customized cleavage.

FIG. 6 shows reinforcing fabric 4 in the area where the panel will be pinned to the bra strap. The reinforcing fabric prevents tears to the fragile fabric of the panel.

FIG. 7 shows the attachment of the fabric panel 10 to the undergarment 1 from the back view. Pins 8 secure the sides 2 of the fabric panel to the straps of the undergarment 1, as described above.

The bottom portion 3 of the fabric panel is pulled taut towards the pants, skirt or underwear 20, as shown in FIG. 4 and FIG. 7. It can be tucked under the waistband 20 to secure it, as shown in FIG. 4. Alternatively, it is secured by pinning the bottom portion 3 to any of the pants, skirt, or underwear, by the use of the flat round-faced pin tack 8 being pushed though the panel and then the garment, secured then by the safety back, as shown in FIG. 7.

The dimensions of the camisole panel of the invention are designed to provide full coverage for most users. For example, the total length of the fabric panel from top to bottom is preferably about 15 inches, but can be up to about 18 inches. The width of the bottom portion 3 is preferably about 5 inches but can be up to about 6 inches. The width of the fabric panel at its vertical center point is preferably about, and a minimum of, 8 inches, but can be up to about 10 inches. The width of the top portion is preferably about 13 inches, but can be up to about 15 inches. It will be understood that the actual dimensions may be varied without departing from the spirit and scope of the invention.

Figure 8:
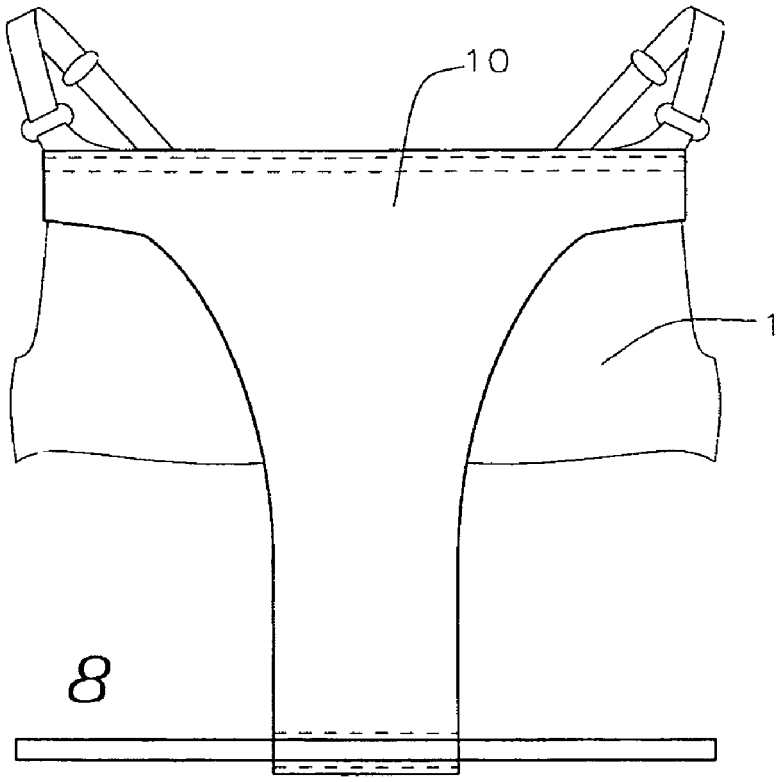
FIG. 8 illustrates a front view of a third preferred embodiment of the invention.
Figure 9:
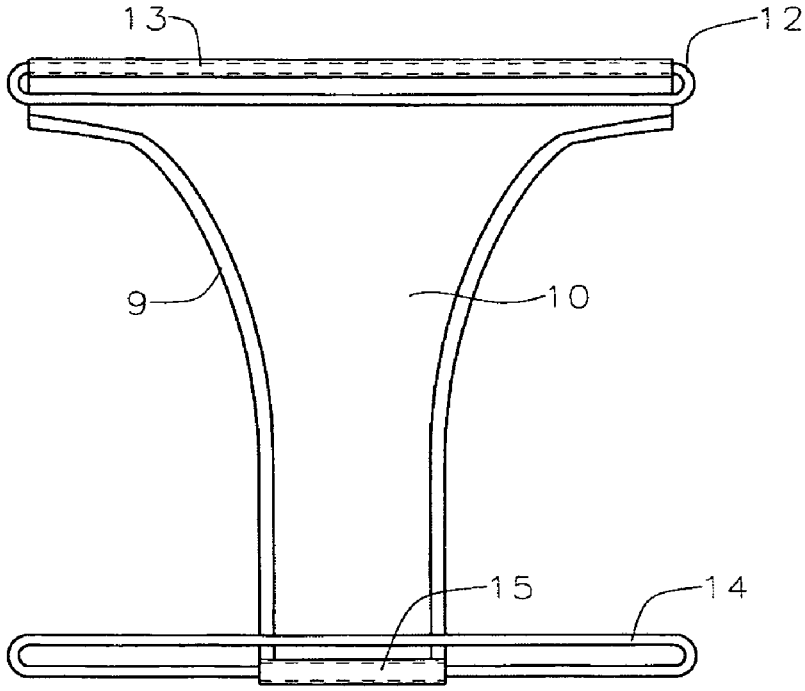
FIG. 9 illustrates a back view of a third preferred embodiment of the invention with two elastic straps.
Figure 10:
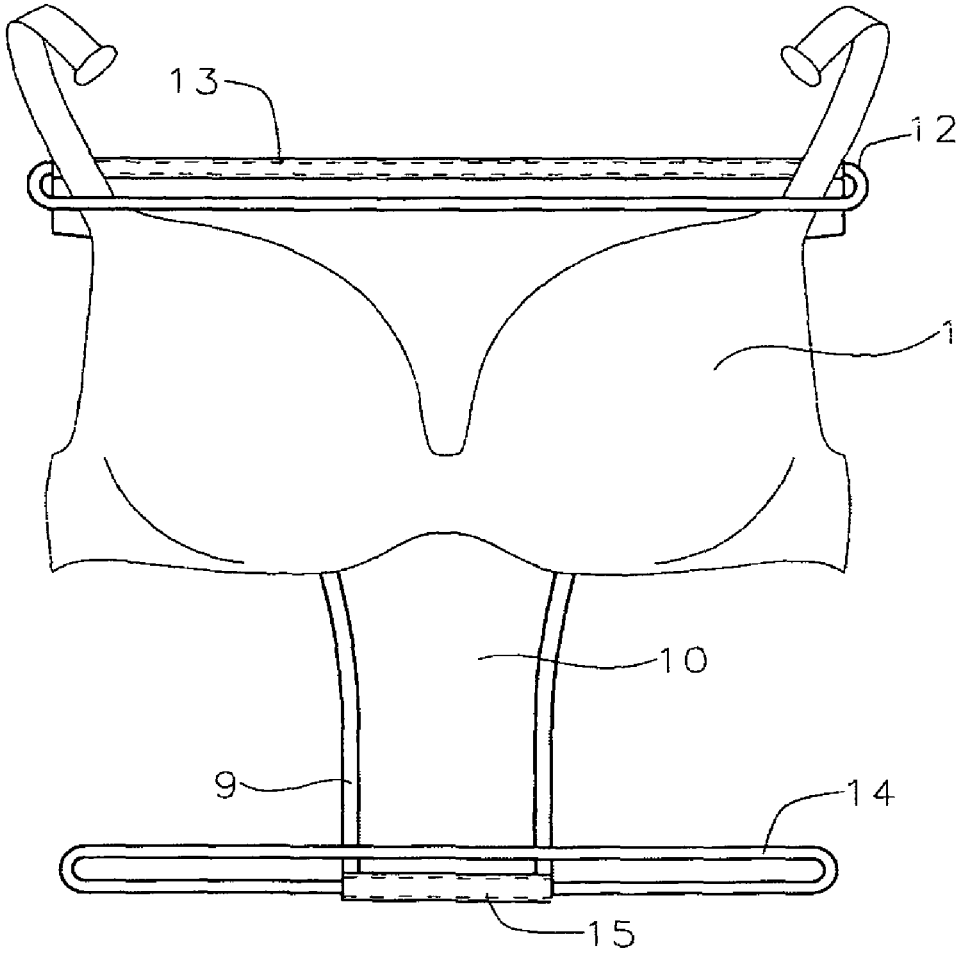
FIG. 10 illustrates a back view of a third preferred embodiment of the invention as applied to a user's undergarment using two elastic straps.

Alternatively, in a third preferred embodiment, the invention is constructed to include two elastic bands, one at the top of the panel and one located at the bottom portion of the panel, as shown in FIGS. 8-10. These elastic bands will wrap around the user's body by running along the back, thus securing the invention to the user's front chest area, without the use of any pins or snaps. FIG. 8 shows a front view of the fabric panel 10. FIG. 9 shows a back view of the fabric panel 10 showing a self-fabric fold 13 on the top of the panel, making a tube for the top elastic strap 12 to fit through. Self-fabric fold 15 at the bottom of the panel makes a tube for the bottom elastic 14 to fit through. FIG. 10 shows the back view of the attached fabric panel 10.

The advantages of using the invention over a traditional camisole are as follows:

1) The invention reduces the amount of bulk and heat under a woman's clothes.

2) With the invention, she can customize her cleavage by raising or lowering the stretch panel, therefore being able to control how little or how much cleavage is displayed.

3) The invention is a "one size fits most" product, which is not true of traditional styles of camisoles that one would wear under a fitted top.

4) The affordability of the invention allows a woman to expand her wardrobe for a much lower expense than if she needed to purchase full, quality fabric or lace camisoles.
5) The invention eliminates the worry of straps showing or falling off her shoulders which may easily happen with many traditional camisoles.
6) The portability of the invention makes packing for trips very easy by being able to pack a variety of panels to replace full camisoles. These panels take up less room than an average handkerchief.
7) The invention offers a seamless look with considerably less material; reducing the common problem of traditional camisoles becoming disheveled and untucked.
8) The invention can be worn with a halter or backless top, which cannot be done with a traditional camisole.

The foregoing description of various and preferred embodiments of the present invention has been provided for purposes of illustration only, and it is understood that numerous modifications, variations and alterations may be made without departing from the scope and spirit of the invention as set forth in the following claims.

What is claimed is:

1. A camisole panel comprised of a fabric material having a top portion having a top horizontal edge between two top vertical sides and a bottom portion having one bottom horizontal edge narrower than said top horizontal edge and centered underneath the top portion and two bottom sides joining said top vertical sides to said bottom horizontal edge, wherein said top sides each have a means to attach to straps of an undergarment covering said user's breasts and wherein said bottom portion has sufficient length to tuck said bottom horizontal edge under a waistband of pants, skirt, or underwear wherein said waistband sits at, above, or below said user's waist and is worn on a lower half of said user's body.

2. The camisole panel according to claim 1, wherein said undergarment is a bra.

3. The camisole panel according to claim 1, wherein said means to attach is snaps, pins, or elastic straps.

4. The camisole panel according to claim 1 wherein said bottom horizontal edge is further attached to said waistband by pins having round flat faces and posts with safety backs.

5. The camisole panel according to claim 1 wherein said means to attach comprises elastic straps wrapping around the user's body and wherein said bottom horizontal edge is also attached to one of said elastic straps at the user's waist.

6. The camisole panel according to claim 3 further comprising reinforcing fabric at said two top sides on a reverse side of said camisole panel in the area where said camisole panel is attached to said undergarment by pins or snaps wherein said reinforcing fabric protects said camisole panel from tearing when it is attached to said undergarment.

7. The camisole panel according to claim 1 wherein said fabric is a two-way stretch fabric.

8. The adjustable fabric panel according to claim 1, wherein said means to attach to said undergarment is selected from the group consisting of snaps, pins, and elastic.

9. The adjustable fabric panel according to claim 1, wherein a length of said adjustable fabric panel from said top horizontal edge to said bottom horizontal edge is between 15 and 18 inches.

10. A camisole panel comprised of a two-way stretch fabric material having a top portion having a top horizontal edge between two top vertical sides and a bottom portion having one bottom horizontal edge narrower than said top horizontal edge and centered underneath the top portion and two bottom sides joining said top vertical sides to said bottom horizontal edge, wherein said top sides each have a means to attach to straps of a user's undergarment, wherein said bottom portion has a length of between 15 and 18 inches so that said bottom horizontal edge can be tucked under a waistband of pants, skirt, or underwear, and wherein said two top sides further comprise reinforcing fabric on a reverse side of said camisole panel in the area where said camisole panel is attached to said undergarment by pins or snaps wherein said reinforcing fabric protects said camisole panel from tearing when it is attached to said undergarment.

11. The camisole panel according to claim 10, wherein said undergarment is a bra.

12. The camisole panel according to claim 10, wherein said means to attach is snaps, pins, or elastic straps.

13. The camisole panel according to claim 10 wherein said bottom horizontal edge is further attached to said waistband by pins having flat round faces and posts with safety backs.

14. The camisole panel according to claim 10 wherein said means to attach comprises elastic straps wrapping around the user's body and wherein said bottom horizontal edge is also attached to one of said elastic straps at the user's waist.

15. The camisole panel according to claim 10 further comprising slip-resistant edges on a reverse side of said camisole pane wherein said slip-resistant edges comprise slip-resistant reinforcing fabric or slip-resistant silicone.

16. A method for applying a camisole panel onto a user comprising the steps of:

providing a camisole panel comprised of a two-way stretch fabric material having a top portion having a top horizontal edge between two top vertical sides and a bottom portion with one bottom horizontal edge narrower than said top horizontal edge and centered underneath the top portion and two bottom sides joining said top vertical sides to said bottom horizontal edge, wherein said top sides each have a means to attach to straps of a user's undergarment;

attaching said top sides to the straps of the user's undergarment; and tucking said bottom horizontal edge under a waistband of pants, skirt, or underwear to secure said camisole panel on the user wherein said waistband sits at, above, or below said user's waist and is worn on a lower half of said user's body.

17. The method according to claim 16, wherein said undergarment is a bra.

18. The method according to claim 16, wherein said means to attach is snaps, pins, or elastic straps.

19. The method according to claim 16 wherein said bottom side is further attached to said waistband by pins having flat round faces and posts with safety backs.

20. The method according to claim 16 wherein said means to attach comprises elastic straps wrapping around the user's body and wherein said bottom horizontal edge is also attached to one of said elastic straps at the user's waist.

21. The method according to claim 16 further comprising reinforcing fabric at said two top sides on a reverse side of said camisole panel in the area where said camisole panel is attached to said undergarment by pins or snaps wherein said reinforcing fabric protects said camisole panel from tearing when it is attached to said undergarment.

22. The method according to claim 16 further comprising slip-resistant edges on a reverse side of said camisole panel wherein said slip-resistant edges comprise slip-resistant reinforcing fabric or slip- resistant silicone.

23. An adjustable fabric panel for attaching to a user's undergarment to provide coverage of the user's exposed cleavage area, said undergarment including at least two shoulder straps connected by material to cover the user's breasts, said adjustable fabric panel comprising:

an integral one piece fabric material having a top portion having a top horizontal edge between a top right side and a top left side, and a bottom portion having a bottom horizontal edge that is narrower than said top horizontal edge and centered under said top portion and two bottom sides joining said top vertical sides to said bottom horizontal edge, wherein said top right side and said top left side each have means to attach to each of said shoulder straps or to said material of said undergarment to position said top portion of the panel to the desired coverage of the user and wherein said bottom portion is not attached to said material of said undergarment.

* * * * *